US008316495B2

(12) United States Patent
He

(10) Patent No.: US 8,316,495 B2
(45) Date of Patent: Nov. 27, 2012

(54) METHOD TO COMPRESS PREFABRICATED DECK UNITS WITH EXTERNAL TENSIONED STRUCTURAL ELEMENTS

(76) Inventor: Yidong He, Naperville, IL (US)

( * ) Notice: Subject to any disclaimer, the term of this patent is extended or adjusted under 35 U.S.C. 154(b) by 121 days.

(21) Appl. No.: 12/857,713

(22) Filed: Aug. 17, 2010

(65) Prior Publication Data

US 2011/0041433 A1 Feb. 24, 2011

Related U.S. Application Data

(60) Provisional application No. 61/274,513, filed on Aug. 18, 2009.

(51) Int. Cl.
*E01D 19/12* (2006.01)

(52) U.S. Cl. ..... 14/77.1; 14/73; 14/74.5; 52/223.7

(58) Field of Classification Search ..... 14/73, 73.1, 14/74–75, 77.1, 78
See application file for complete search history.

(56) References Cited

U.S. PATENT DOCUMENTS

| | | | | |
|---|---|---|---|---|
| 3,676,968 | A * | 7/1972 | Campbell | 52/223.6 |
| 3,892,096 | A * | 7/1975 | Macchi | 52/223.11 |
| 5,437,072 | A | 8/1995 | Dinis et al. | |
| 5,457,839 | A | 10/1995 | Csagoly | |
| 5,577,284 | A | 11/1996 | Muller | |
| 6,065,257 | A * | 5/2000 | Nacey et al. | 52/223.8 |
| 6,265,257 | B1 * | 7/2001 | Hsu et al. | 438/215 |
| 6,345,403 | B1 * | 2/2002 | Nagle | 14/77.1 |
| 6,470,524 | B1 | 10/2002 | Mairantz | |
| 6,588,160 | B1 * | 7/2003 | Grossman | 52/223.7 |
| 6,668,412 | B1 | 12/2003 | Tadros et al. | |
| 6,857,156 | B1 * | 2/2005 | Grossman | 14/73 |
| 6,857,456 | B2 * | 2/2005 | Manning | 144/286.5 |
| 7,197,854 | B2 * | 4/2007 | Bettigole et al. | 52/414 |
| 7,373,683 | B2 | 5/2008 | Moon | |

(Continued)

FOREIGN PATENT DOCUMENTS

EP 0603060 A1 12/1993

OTHER PUBLICATIONS

Abu-Hawash et al. Accelerated Design and Construction for the 24th Street Bridge in Council Bluffs, Iowa. Proceedings of the 2007 Mid-Continent Transportation Research Symposium, Ames, Iowa, Aug. 2007. by Iowa State University.

(Continued)

*Primary Examiner* — Raymond W Addie

(57) ABSTRACT

A structural system comprised of prefabricated deck units spaced along longitudinal load-carrying members with tensioned structural elements, typically anchored in longitudinal load-carrying members, which produce longitudinal axial compression in these units. During construction, prefabricated deck units are erected on top of and supported by the longitudinal load-carrying members via leveling devices. Leveling devices permit relative motion between the longitudinal load-carrying members and the prefabricated deck units, except at two ends of a structural unit, where deck connection units are connected to longitudinal members. In the longitudinal direction, each girder line contains more than one girder or girder segment and the girders or girder segments are not continuous during tensioning. The girder support allows the girder or girder segments to move in the longitudinal direction. When the tensioned structural elements are stressed, the longitudinal component of the tensioned structural element can become compression in the deck. Tensioned structural elements in the girder or girder segments are deviated relative to the horizontal plane of the prefabricated deck units, subsequently enhancing the load-carrying capacity of the longitudinal load-carrying members.

12 Claims, 8 Drawing Sheets

U.S. PATENT DOCUMENTS

| | | | | |
|---|---|---|---|---|
| 7,421,825 | B2 * | 9/2008 | Skendži et al. | 52/223.8 |
| 7,461,427 | B2 | 12/2008 | Ronald et al. | |
| 7,475,446 | B1 | 1/2009 | He | |
| 8,020,235 | B2 * | 9/2011 | Grace | 14/74.5 |
| 2002/0083659 | A1 * | 7/2002 | Sorkin | 52/167.1 |
| 2003/0082883 | A1 * | 5/2003 | Welser | 438/386 |
| 2008/0209646 | A1 | 9/2008 | Abardia Garcia | |
| 2010/0139015 | A1 | 6/2010 | Bumen | |
| 2011/0099941 | A1 * | 5/2011 | Yegge | 52/831 |

OTHER PUBLICATIONS

Full Depth Precast Concrete Deck Panel Manual, Utah Department of Transportations. May 2009.

* cited by examiner

METHOD TO COMPRESS PREFABRICATED DECK UNITS WITH EXTERNAL TENSIONED STRUCTURAL ELEMENTS

CROSS-REFERENCE TO RELATED APPLICATIONS

This application claims the benefit of U.S. Provisional Application No. 61/274,513, filed Aug. 18, 2009.

FEDERALLY SPONSORED RESEARCH

Not Applicable

SEQUENCE LISTING OR PROGRAM

Not Applicable

BACKGROUND OF THE INVENTION

1. Field of Invention

This invention relates to the design and construction of structures, specifically to structures with prefabricated deck units.

2. Prior Art

Full-depth precast concrete deck has gained popularity as an accelerated construction method. Use of full-depth precast concrete deck allows for the deck concrete and reinforcement to be placed in a controlled environment, improving the quality of the deck. Since the units are prefabricated, they can be delivered to a site and erected quickly.

Structures using full-depth precast concrete deck typically consist of a plurality of longitudinally spaced concrete units supported by longitudinal load-carrying members. These members are usually a single girder or multiple girders or beams. This member or members can be comprised of various materials including steel, concrete or fiber-reinforced plastic.

When no longitudinal post-tensioning is used in conjunction with a precast concrete slab deck, the use of cast-in-place joints between precast deck units is required. The cast-in-place joint requires extensive fieldwork and the uncompressed joint typically exhibits long-term maintenance and durability problems.

An improvement that has been made to precast concrete decks is to introduce longitudinal post-tensioning. The post-tensioning can provide a compression force across the deck joints, whereby improving the durability of cast-in-place joints. With the exception of the technology proposed in U.S. Pat. No. 7,475,446 B1, all current precast deck construction employs internal post-tensioning, wherein post-tensioning ducts or sheaths are embedded inside the concrete deck. The current practice of using internal post-tensioning has several disadvantages, including:

a. The extensive ductwork in the precast concrete deck units requires the ducts to be placed very accurately so that they will align with the ducts in the adjacent unit.
b. Duct coupling is required at the joints between the precast concrete deck units, which is time consuming and a labor intensive process. If a duct is not coupled properly, jointing materials can leak into the duct and cause duct blockage. This can result in significant construction delays and construction quality problems.
c. The internal post-tensioning is vulnerable to corrosion, particularly in climates where deicing chemicals are used. These chemicals can penetrate through the concrete and corrode the post-tensioning steel, especially at locations where the post-tensioning ducts are coupled.

U.S. Pat. No. 7,475,446 B1 provides a solution to introduce post-tensioning external to the deck, using a method to transfer longitudinal compression to the deck units when all deck units are non-composite with the longitudinal load-carrying members and with longitudinal tensioning elements anchored at one more specially designed deck end units. The proposed method discussed herein also provides a solution to introduce post-tensioning external to the deck, but utilizes composite deck connection units in the transfer of longitudinal compression to the deck units and does not necessarily require anchorage of the tensioning elements into the deck units, as the tensioning elements can also be anchored in the longitudinal load-carrying members themselves or other locations.

BACKGROUND OF THE INVENTION—OBJECTS AND ADVANTAGES

Accordingly, several objects and advantages of the present invention are to provide a structural system that:

a. facilitates rapid construction of a structure, wherein increasingly tight construction schedules and/or site constraints can be accommodated;
b. allows for post-tensioning to be placed external to the deck, whereby significantly simplifying post-tensioning placement and eliminating the need for post-tensioning duct coupling at deck unit joints;
c. allows for post-tensioning to not only subject the deck to compression, but also allows for post-tensioning to conjointly subject the deck to compression and increase the overall load resistance of the structure, whereby significantly reducing the amount of material required in the longitudinal load carrying members
d. produces a structure that enhances the durability of the deck;
e. allows for post-tensioning to be placed entirely external to the deck, eliminating the need for special deck end units to facilitate the anchoring of post-tensioning tendons;
f. provides all other objects and advantages while facilitating the use of longitudinal load-carrying members of various lengths, various cross-sections and various materials, whereby providing owners, designers and contractors flexibility to achieve the best overall economy in their choice of longitudinal load-carrying members.

Further objects and advantages will become apparent from a consideration of the ensuing description and drawings.

SUMMARY

In accordance with the present invention a structural construction system comprises prefabricated deck units spaced along longitudinal load-carrying members with tensioned structural elements. Axial compression of these prefabricated deck units is produced through the use of composite deck connection units by tensioned elements typically anchored in the deck units or in longitudinal load-carrying members.

DRAWINGS—FIGURES

DRAWINGS—REFERENCE NUMERALS

Figure 1:
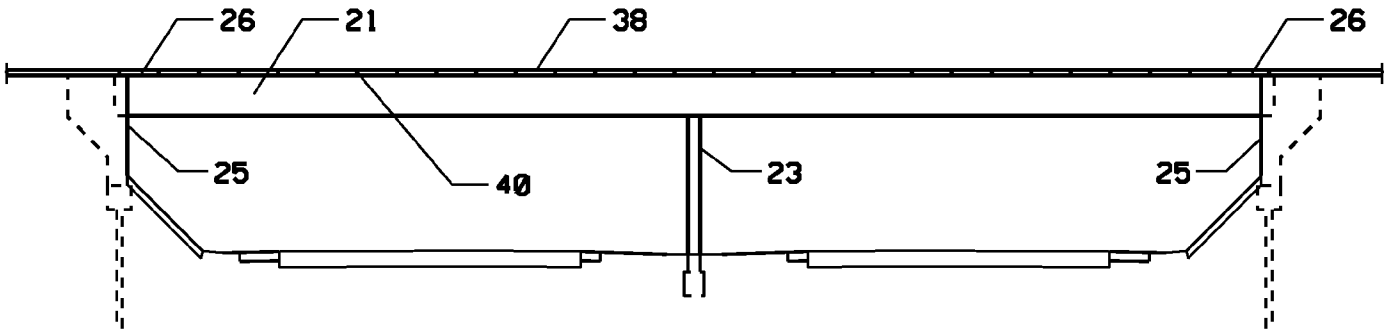
FIG. 1 shows the elevation view of an example bridge used to describe the present invention.
Figure 2:
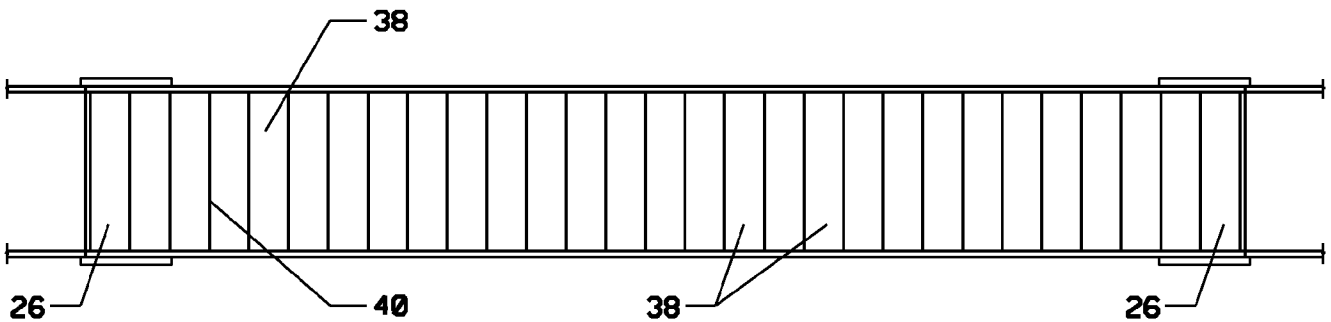
FIG. 2 shows the plan view of the example bridge.
Figure 3:
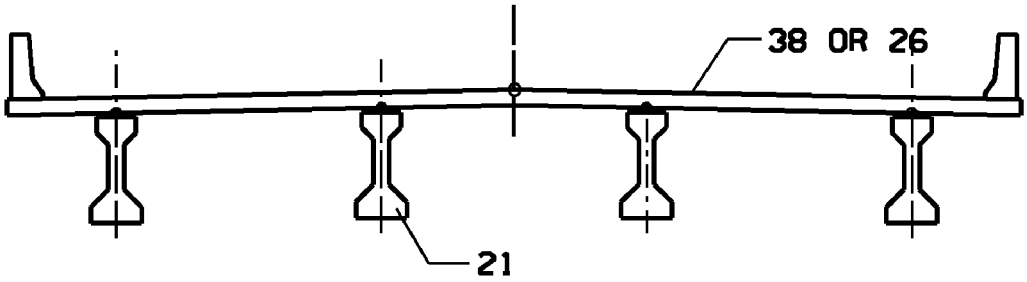
FIG. 3 shows the general cross section of the example bridge

20 post-tensioning anchorage
21 concrete girder
22 post-tensioning duct
23 pier
24 gap at pier between girders
25 abutment
26 deck connection unit
27 shims
28 void for shear connectors
29 shear keys
30 haunch
34 deviation points
38 precast deck unit
40 joint
48 pier diaphragm
50 shear studs
52 post-tensioning tendons
54 pretensioning strands
58 shear stud base
64 girder end block
65 high strength bolt
66 embedded bolt anchor
67 precast U girder
68 external post tensioning duct
69 post tensioning duct internal to girder section

DETAILED DESCRIPTION—FIGS. 1 THROUGH 7—PREFERRED EMBODIMENT

A preferred embodiment of the bridge construction system of the present invention is illustrated in FIGS. 1 through 6 in the context of a two-span bridge, hereinafter referred to as "example bridge". The example bridge has two abutments 25 and a pier 23 acting as substructure units. The preferred embodiment of the bridge construction system is comprised of concrete girders 21 acting as longitudinal load-carrying members, precast concrete deck units 38 or 26 acting as prefabricated deck units and post-tensioning tendons 52 acting as tensioned structural elements. The precast concrete deck units can be constructed using long or short line match-casting or without match-casting.

However, those features comprising the structural construction system mentioned in the preferred embodiment and the substructure and span arrangement mentioned above can have various embodiments not mentioned in the preferred embodiment, as discussed in detail hereinafter and as will become apparent from a consideration of the ensuing description and drawings.

Concrete girders 21 are placed on and supported by abutments 25 and pier 23. Girder post-tensioning tendons 52 are anchored at the end of concrete girders 21 next to abutments. Concrete girders 21 are of bulb-T beams, but may be of any suitable structural shape, such as U-beams, box beams, etc. On top of concrete girders 21, a plurality of leveling devices is placed that allow for relative longitudinal motion between concrete girders 21 and the precast concrete deck units 38 or 26. In the preferred embodiment, the leveling devices are comprised of shims 27, however leveling bolts or other devices that can provide support for the deck and allow for relative longitudinal motion between concrete girders 21 and the precast concrete deck units 38 or 26 can be used. As will be evident from the description hereinafter, this allowance for relative motion will allow for the precast concrete deck units to be compressed by the tensioning of post-tensioning tendons 52. Shims 27 may be of steel, plastic, elastomeric materials, teflon-based or teflon-impregnated materials, etc.

A plurality of voids 28, similar to those used in conventional precast deck placement, are provided in deck units 38 or 26 above concrete girders 21 to allow for mechanical connection of deck units to concrete girders 21 by means of shear connectors. The voids 28 will be grouted in two different stages, first for the deck connection units 26 and the second for all other deck units 38, as hereinafter described in detail. Deck connection units 26 in typical situations are defined as the last deck unit at each end of the bridge, and in the typical embodiment consist of precast concrete deck units, but may consist of slabs, panels, brackets, blocks or corbels, etc. Haunches 30 will also be grouted at the same time as the shear connectors. Shear connectors shall be detailed to allow relative motion between precast concrete deck units and concrete girders 21 during the precast concrete deck unit erection process, as hereinafter described. In the preferred embodiment, shear connectors are shear studs 50 and shear stud base 58. Shear stud base 58 is comprised of steel plates embedded in concrete girders 21. Shear studs 50 are welded to shear stud base 58 after precast concrete deck units are in place. Other types of shear connectors can be used, such as reinforced bars protruding from girders 21 or other devices that can transfer the horizontal shear force between the precast concrete deck units and concrete girders 21 after voids 28 and haunches 30 are grouted.

Figure 5:
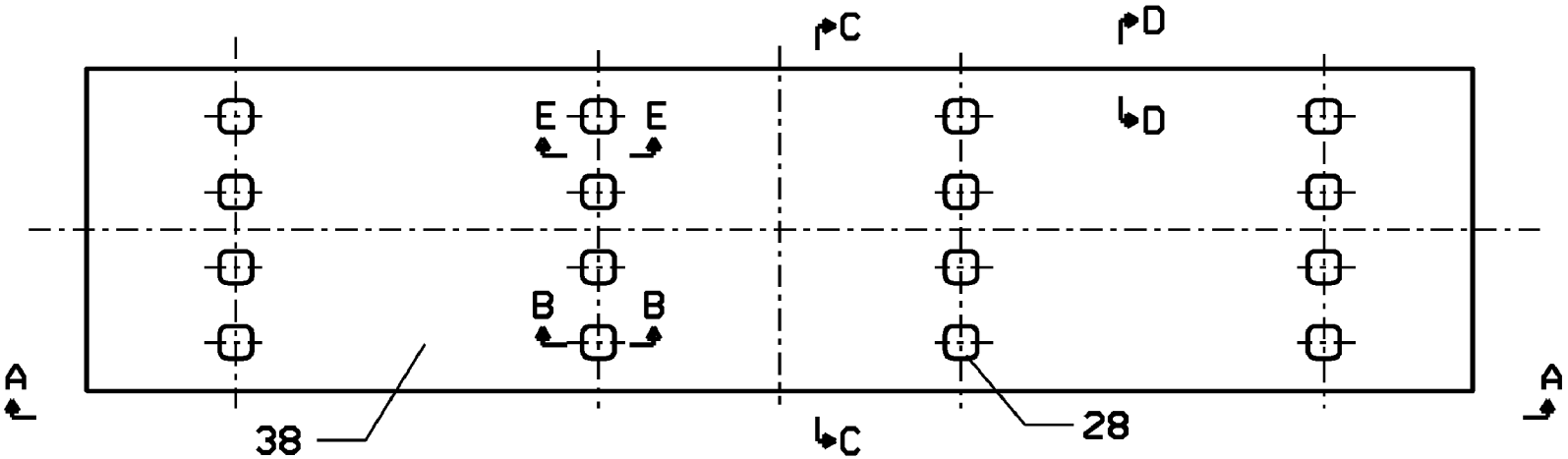
FIG. 5 shows the plan view of a typical deck unit
Figure 5A:
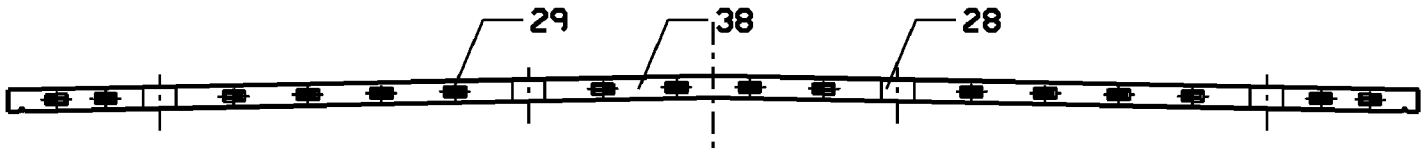
FIG. 5A shows the section of a typical deck joint
Figure 5C:
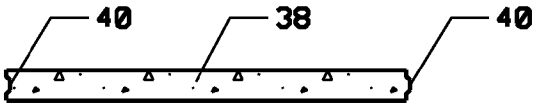
FIG. 5C shows the detail of a match cast joint
Figure 5E:
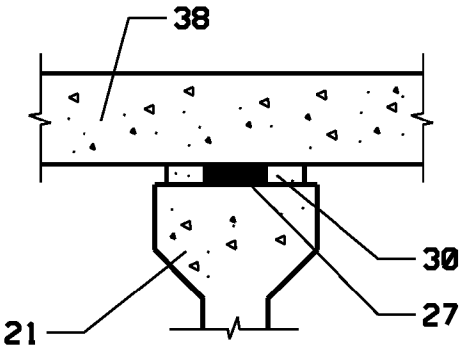
FIG. 5E shows the detail of leveling device
Figure 5B:
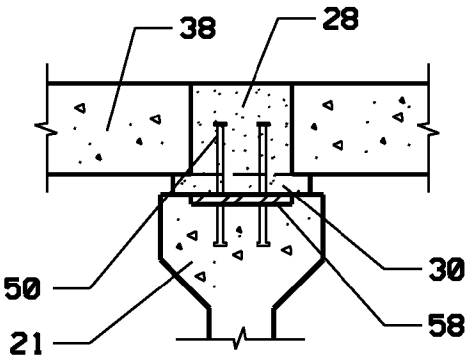
FIG. 5B shows the detail of shear connectors and void for shear connectors
Figure 5D:
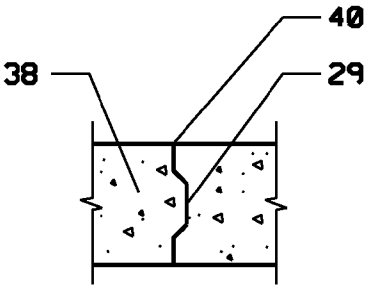
FIG. 5D shows the transverse cross-section of a typical unit
Figure 6:
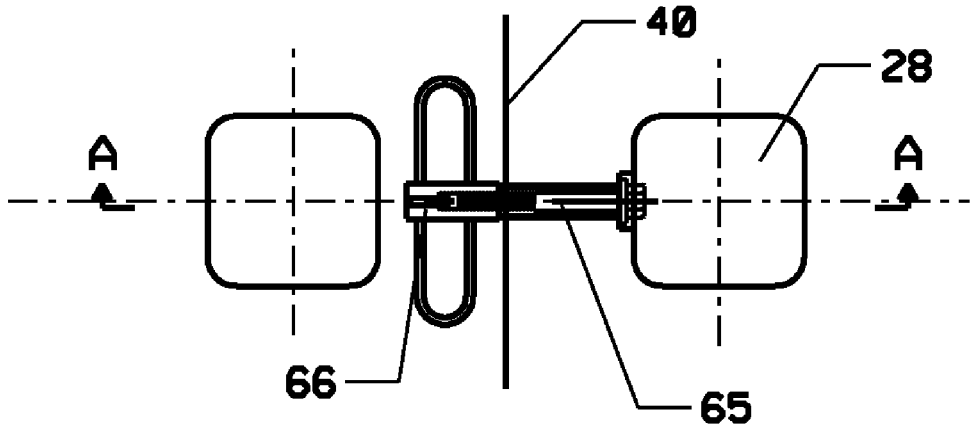
FIGS. 6-6A show the device to provide compression stress during epoxy jointing
Figure 6A:
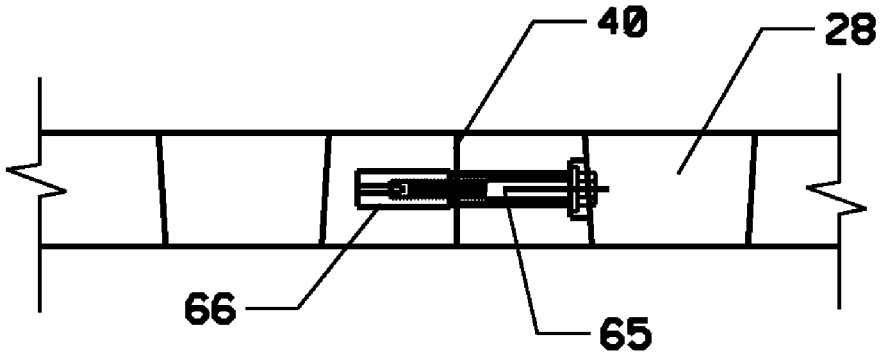

Joints between adjacent precast concrete deck units can be of the match-cast type, with or without epoxy, as shown in FIG. 5C, or cast-in-place using concrete, grout or other suitable jointing material. In the preferred embodiment, match-cast epoxy joints are used. Therefore, provision to provide initial compressive stress during epoxy jointing is needed. FIG. 6 shows a device used for such a provision. This device is to allow for the individual precast concrete deck units to be tightened together by tensioning high strength bolts 65 prior to the stressing of post-tensioning tendons 52. An alternate to the above device is to use temporary erection post-tensioning bars as commonly employed in precast concrete segmental bridge construction.

Figure 4:
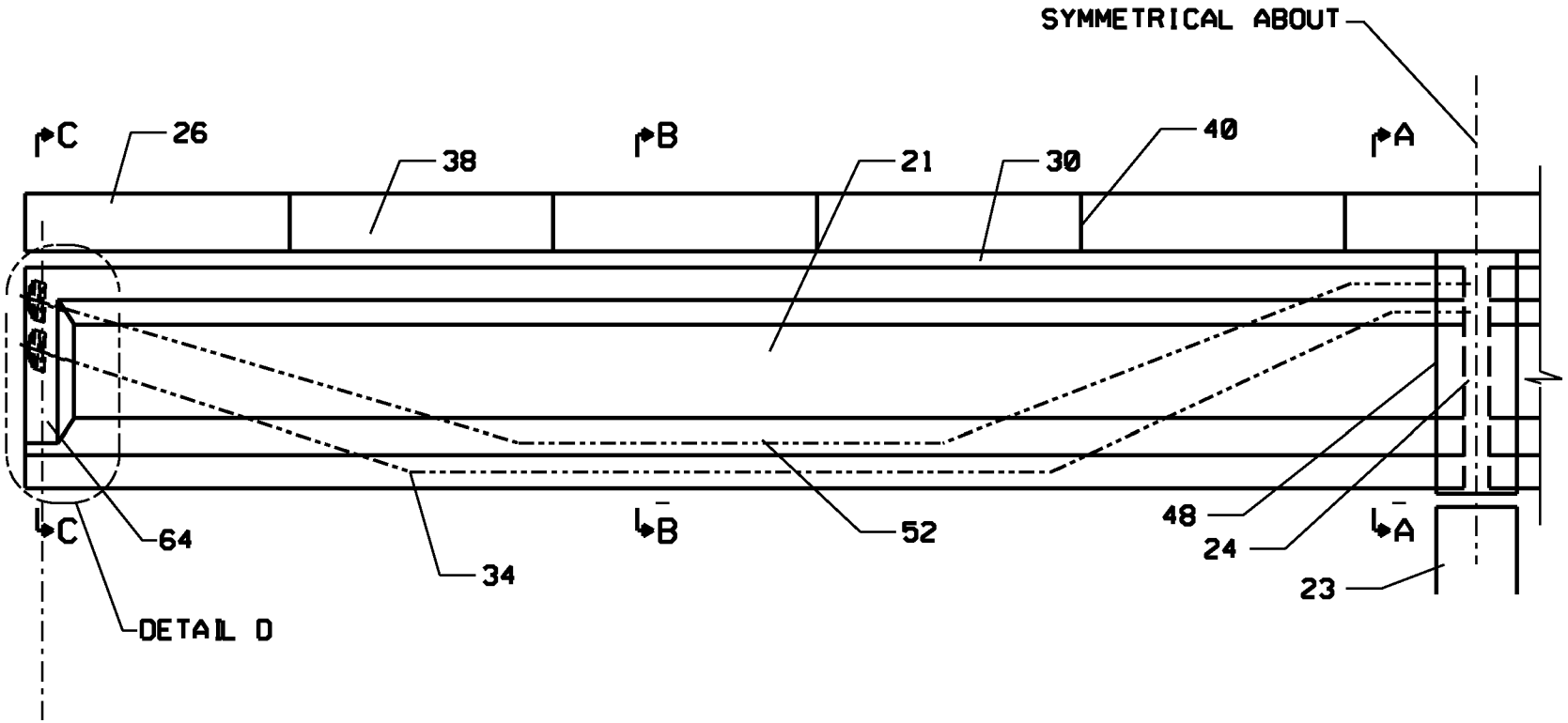
FIG. 4 shows the girder elevation and longitudinal post-tensioning tendons
Figure 4A:
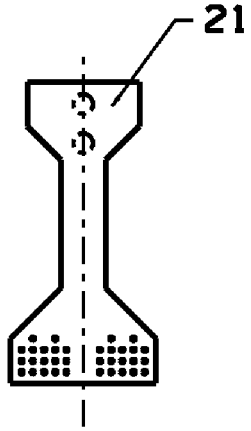
FIGS. 4A-4C show girder cross sections
Figure 4B:
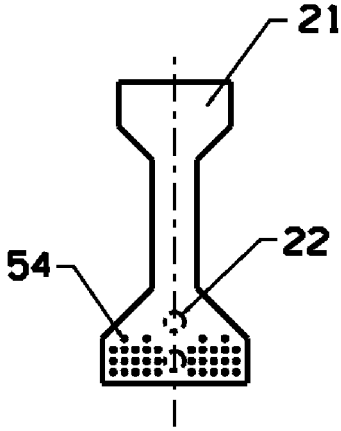
Figure 4C:
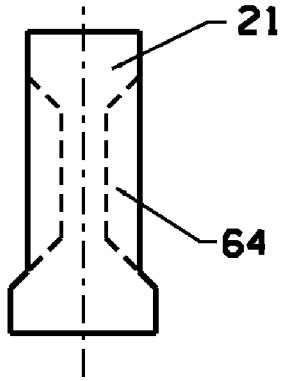
Figure 4D:
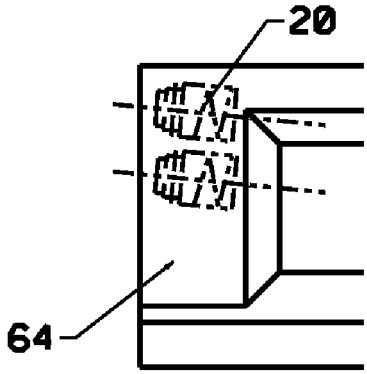
FIG. 4D shows girder end block and post-tensioning anchor details

In the preferred embodiment, post-tensioning tendons 52 are anchored at the girder ends as shown in FIGS. 4 and 4D and are vertically deviated within the web of the concrete girder. Post-tensioning tendons 52 may be high strength steel wires, strands, or other elements or materials capable of withstanding high tensile stresses.

Figure 7:
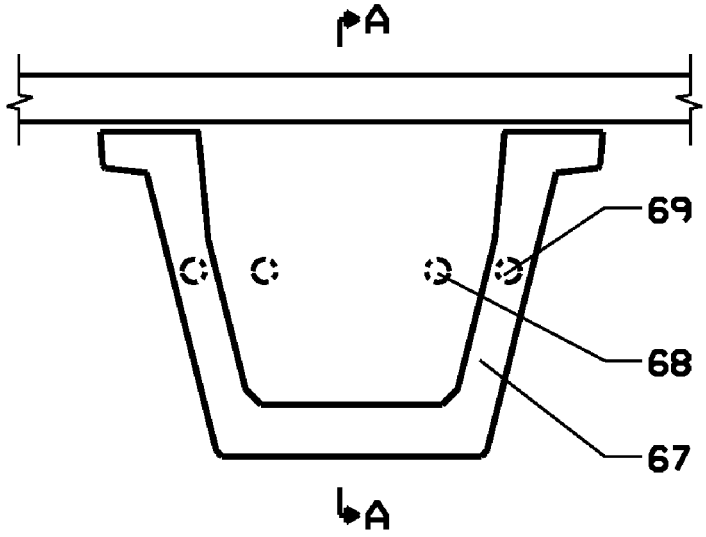
FIGS. 7-7A show post-tensioning options for precast U girders.
Figure 7A:
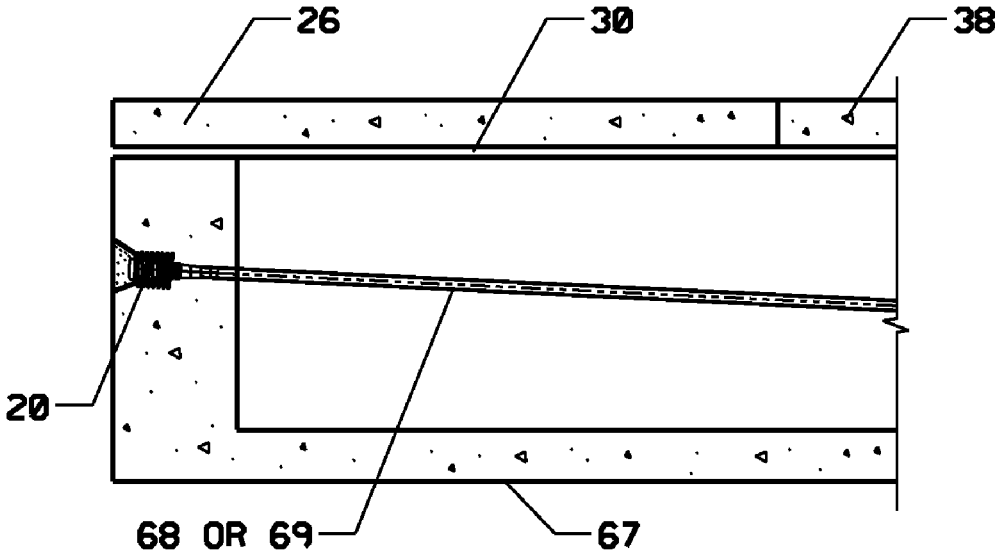

Alternate embodiments for the present invention are described hereinafter:

a. The prefabricated deck units can be comprised of any other material that is suitable for supporting loads anticipated to be applied to the deck units, such as composite material, wood, steel-concrete composite units, etc.

b. The deck connection units can be comprised of any other form that is suitable for transferring the anticipated loads between the longitudinal load-carrying members and the prefabricated deck units, such as brackets, blocks, panels, slabs, corbels, etc. and can be comprised of any other material that is suitable for transferring the anticipated loads, such as steel, concrete, composite material, etc.

c. The longitudinal load-carrying members or member segments can be comprised of any other material or cross-section suitable to support the loads applied to these members such as steel I-girders, precast prestressed concrete U beams, composite material I-girders, single or multiple box girders of steel or concrete, trusses, wood beams, etc.

d. Post-tensioning tendons can be placed either internal or external, or a combination of internal and external, to the section of the longitudinal load-carrying members themselves. Examples of placing the post-tensioning tendons internal to the longitudinal load-carrying members are illustrated in the preferred embodiment, in which the post-tensioning runs through the web of precast concrete I-beam. FIG. 7 shows an example of how the external and internal post-tensioning tendons can be placed with a precast U beam section.

e. The present invention can be applied to bridges with curved or kinked girder arrangements. With such an arrangement, post-tensioning tendons will be deviated horizontally, following the girder geometry, in addition to the vertical deviation as heretofore described in regard to the example bridge. Additional intermediate diaphragms can be used to provide horizontal deviations as needed. Care should be taken in designing the intermediate diaphragms and deck-to-girder connections to ensure the horizontal deviation force can be transferred between the deck and girder.

f. The tensioned structural elements (TSE) can be anchored in any combination that facilitates the relative motion between the longitudinal load-carrying members or member segments (LLCMs) while still transferring compression to the prefabricated deck units (PDUs) such as: both TSE ends anchored in the LLCMs, both TSE ends anchored in the PDUs, one TSE end anchored in the LLCMs and the other TSE end anchored in the PDUs, one TSE end anchored in an external rigid element, such as an abutment, and the other TSE end anchored in the PDUs or LLCMs.

g. The longitudinal load-carrying members can be erected in member segments on falsework or other temporary means such that relative motion between the member segments can occur during stressing of the tensioned structural elements. The member segments can then be spliced into full longitudinal load-carrying members prior to removing the temporary means and placing the structure into service.

h. Though the preferred embodiment of the present invention is presented in the context of bridges, it is not limited to bridge applications. Any structural application requiring decking support by longitudinal load-carrying members can utilize the present invention in alternate embodiments such as building floor systems and building roof systems.

OPERATION

The preferred embodiment in the context of the example bridge is illustrated hereinafter.

Abutments 25 and pier 23 are constructed. Concrete girders 21 are fabricated with post-tensioning ducts, post-tensioning anchors and shear connectors 50. A plurality of precast concrete deck units, comprising deck connection units 26 and typical units 38 are fabricated at a precast concrete facility and transported to the bridge site.

Concrete girders 21 are erected onto abutments 25 and pier 23. Concrete girders are supported by bearings or similar means, which can allow small movements of girder in the longitudinal direction of the bridge. A gap between girders, in the longitudinal direction of the bridge, is maintained at each pier location.

After concrete girders 21 are erected, the girder top elevation is surveyed and the shim thickness at each supporting point will be calculated so as to provide the correct setting elevations for deck units. A plurality of shims 27 is placed on top of the concrete girders.

Post-tensioning tendons 52 are run through post-tensioning ducts 22 and installed in post-tensioning anchorages 20. Post-tensioning ducts are coupled at pier locations; at this time, the couplers are loosely fit to allow for gap closing caused by future stressing.

Deck units are erected, placing one unit adjacent to the previously erected one and applying epoxy to the adjacent faces of the two units. High strength connection bolts 65 are then installed and tightened to ensure the gap between the adjacent units is sufficiently tight to allow the epoxy to set. This process is continued until both deck connection units 26 and all typical units 38 are installed.

After all deck units are erected, shear connector pockets and haunches of the deck connection units 26 are grouted. After grout reaches the design strength and the composite action between the deck connections units 26 and the girders is developed, post-tensioning tendons 52 are now stressed in what is hereinafter referred to as "Stage 1 Stressing". Since at this time the girder can have longitudinal motion relative to the substructure and gaps between girders are left at pier locations, the girders do not resist the longitudinal components of post-tensioning force. Instead, the longitudinal component of the post-tensioning force is transferred through the deck connection units 26 and compresses all typical deck units 38 in between. Vertical deviation of the post-tensioning tendons 52 allows for the application of vertical forces to concrete girders 21.

These vertical forces significantly increase the load-carrying capacity of concrete girders 21.

After Stage 1 Stressing, voids 28 and haunches 30 of all remaining deck units are filled with grout, whereby making precast concrete deck units composite with concrete girders 21. Then, post-tensioning duct couplers at the pier are sealed.

Pier diaphragm 48 is poured using concrete, whereby making concrete girder 21 continuous between the two spans. Post-tensioning tendons 52 are then further stressed in what is hereinafter referred to as "Stage 2 Stressing". Since the precast concrete deck units are now composite with concrete girders 21, Stage 2 Stressing engages the composite section similar to a typical post-tensioned set of girders. These increased vertical forces further increase the load-carrying capacity of concrete girders 21. Stage 2 Stressing has the added benefit of applying axial longitudinal compression forces to the composite section, both the precast concrete deck units and concrete girders 21, further increasing the durability and load-carrying capacity of the bridge.

After Stage 2 Stressing, post-tensioning tendons 52 are grouted, and other miscellaneous finishing details typical to bridge construction are accomplished, such as installation of cast-in-place or precast parapets, completion of bridge approaches, etc.

Post-tensioning tendons 52 stressed in Stage 1 will result in different stress distributions in the bridge than those resulting from Stage 2 Stressing. The amount of stressing force in each stage should be evaluated to achieve the most favorable outcome for the bridge. Post-tensioning tendons 52 can be stressed entirely in Stage 1, with no stressing in Stage 2, if desired.

Pier diaphragms, or other means to make the girder continuous over a pier, are optional. The girders can remain simple span when the bridge is in service. If girders remain simple span, Stage 2 Stressing is not applicable.

The operational description above is particular to the preferred embodiment of the present invention in the context of the two-span bridge heretofore defined. Alternate materials, member shapes, stressing stages, etc. can be used in employing the structural construction system of the present invention.

ADVANTAGES

The present invention provides a structural system that eliminates many of the drawbacks found in current precast deck construction. Notably, it prevents potential duct conflicts and blockages by eliminating the need to couple deck post-tensioning ducts at deck joints. The durability of the deck and post-tensioning system is doubly enhanced by first, placing the post-tensioning system below the deck, whereby significantly reducing the susceptibility of the post-tensioning tendons to corrosion, and second, providing longitudinal compression in the deck, which greatly reduces cracking and subsequent intrusion of corrosive agents.

Beyond simply providing a system that eliminates drawbacks in current precast deck construction, the present invention, through the deviation of the post-tensioning tendons herein discussed, also can increase the load carrying capacity of longitudinal load-carrying members.

Another significant advantage of the present invention is its flexibility in providing the objects and advantages herein stated, all while accommodating a variety of girder shapes and materials, cast-in-place and match cast deck joints, and span configurations and lengths. In addition to this, the present invention does not require construction equipment not already common to precast deck construction and facilitates rapid construction.

Further, for multiple spans, the present invention does not necessarily require special deck end units to anchor the post-tensioning tendons, as contemplated in the invention of U.S. Pat. No. 7,475,446 B1, as post-tensioning tendons can be anchored solely in the longitudinal load-carrying members.

CONCLUSION, RAMIFICATIONS, AND SCOPE

In conclusion, the present invention, through its use of innovative construction sequences, provides a structural construction system that is durable, easy to construct and cost effective. The present invention can accommodate a variety of structural configurations and can be rapidly constructed. All this while enhancing the load carrying capacity of the girders, and subsequently reducing required materials for these members.

Although the description above contains many specificities, these should not be construed as limiting the scope of the invention but as merely providing illustrations of some of the presently preferred embodiments of this invention. For example, as illustrated and described herein, the present invention can accommodate a variety of lengths, shapes and materials for the prefabricated deck units, deck connection units, longitudinal load-carrying member and tensioned structural elements.

Thus the scope of the invention should be determined by the appended claims and their legal equivalents, rather than by the examples given.

I claim:

1. A structural system, comprising:

a. a plurality of longitudinal load-carrying members or longitudinal load-carrying member segments, b. a plurality of prefabricated deck units spaced longitudinally along a structure, wherein said prefabricated deck units are fully or partially supported by said longitudinal load-carrying members, c. a plurality of said prefabricated deck units, wherein two or more prefabricated deck units are composite with two or more of said longitudinal load-carrying members, herein denoted deck connection units, and one or more of said prefabricated deck units are situated between said deck connection units and are non-composite with said longitudinal load-carrying members at the time at which tensioning is applied to one or more tensioned structural elements, herein denoted typical prefabricated deck units, d. one or more of said tensioned structural elements are external to one or more of said prefabricated deck units, wherein the ends of said tensioned element or elements are anchored in any combination of elements selected from the group, herein considered anchor elements, consisting of said longitudinal load-carrying members, herein denoted anchor members, or said deck connection units, herein denoted anchor units, e. one or more gaps situated longitudinally between said anchor members or said longitudinal load-carrying members made composite with said anchor units at the time at which tensioning is applied to said tensioned structural element or elements, wherein said anchor elements situated to either side of said gaps longitudinally anchor the two ends of the same said tensioned structural element, f. means for transferring tension in said tensioned structural element or elements into longitudinal axial compression in said typical prefabricated deck units without shedding said longitudinal axial compression into said longitudinal load-carrying members or member segments prior to said prefabricated deck units, other than deck connection units, being made composite with said longitudinal load-carrying members or member segments.

2. The longitudinal load-carrying members or member segments of claim 1 are comprised of any combination of members selected from the group consisting of steel, concrete and composite materials.

3. The longitudinal load-carrying members or member segments of claim 1 are comprised of any combination of members selected from the group consisting of I-girders, I-beams, box girders, or trusses.

4. The structural system of claim 1 provides a means to transfer vertical force resulting from a deviation of said tensioned structural element or elements in relation to the horizontal plane of said prefabricated deck units, wherein said tensioned structural element or elements assist said longitudinal load-carrying members in resisting load.

5. The structural system of claim 1, wherein the tensioned structural element or elements are post-tensioning strands or post-tensioning bars or a combination of post-tensioning strands and post-tensioning bars.

6. The tensioned structural element or elements of claim 1 can be stressed subsequently after the stressing stated in claim 1.

7. A method for constructing a structure comprising the steps of:

a. constructing a plurality of prefabricated deck units, b. constructing a plurality of supports for the structure, c. constructing a plurality of longitudinal load-carrying members or member segments, d. installing said longitudinal load-carrying members or member segments, wherein said longitudinal load-carrying members or member segments are supported by said supports, and wherein a gap is provided between two or more of said members lying in the same longitudinal line, e. installing a plurality of said prefabricated deck units, wherein said prefabricated deck units are supported by said longitudinal load-carrying members or member segments and rest on devices that permit relative motion between said prefabricated deck units and said longitudinal load-carrying members or member segments, f. installing tensioned structural element or elements, wherein the ends of said tensioned structural element or elements are anchored in any combination of elements selected from the group consisting of said longitudinal load-carrying members or said deck connection units, and wherein a portion of said tensioned structural element or elements lie across said gap, g. making two or more of said prefabricated deck units composite with said longitudinal load-carrying members or member segments, wherein said composite deck units become deck connection units, and wherein one or more of said prefabricated units non-composite with said longitudinal load-carrying members or member segments are situated between said composite prefabricated deck units, herein denoted typical prefabricated deck units, h. tensioning said tensioned structural element or elements, wherein said tensioning induces longitudinal axial compression in said typical prefabricated deck units without shedding axial compression into said longitudinal load-carrying members or member segments, i. making said typical prefabricated deck units composite with said longitudinal load-carrying members or member segments.

8. The method of claim 7, wherein the longitudinal load-carrying members or member segments are comprised of any combination of members selected from the group consisting of steel, concrete and composite material.

9. The method of claim 7, wherein the longitudinal load-carrying members or member segments are comprised of any combination of members selected from the group consisting of I-girders, I-beams, box girders, or trusses.

10. The method of claim 7, wherein a means to transfer vertical force resulting from a deviation of said tensioned structural element or elements in relation to the horizontal plane of said prefabricated deck units is provided, wherein said tensioned structural element or elements assist said longitudinal load-carrying members in resisting load.

11. The method of claim 7, wherein the tensioned structural element or elements are post-tensioning strands or post-tensioning bars or a combination of post-tensioning strands and post-tensioning bars.

12. The method of claim 7, wherein the tensioned structural element or elements can be stressed subsequently after the tensioning stated in claim 7 (h).

* * * * *